US005148705A

United States Patent [19]

Desbrandes

[11] Patent Number: 5,148,705

[45] Date of Patent: Sep. 22, 1992

[54] METHOD AND APPARATUS FOR DETERMINING THE WETTABILITY OF AN EARTH FORMATION

[75] Inventor: Robert Desbrandes, Baton Rouge, La.

[73] Assignee: Louisiana State University and Agricultural and Mechanical College, Baton Rouge, La.

[21] Appl. No.: 542,576

[22] Filed: Jun. 25, 1990

[51] Int. Cl.[5] ..... E21B 49/00

[52] U.S. Cl. ..... 73/152

[58] Field of Search ..... 73/153, 152, 155, 151; 166/264, 100

[56] References Cited

U.S. PATENT DOCUMENTS

| | | | |
|---|---|---|---|
| 2,747,401 | 5/1956 | Doll | 73/151 |
| 3,115,775 | 12/1963 | Russell | 73/152 |
| 4,210,018 | 7/1980 | Brieger | 73/155 |

OTHER PUBLICATIONS

Anderson, W. G., "Wettability Literature Survey-Part 2 Wettability Measurement", Journal of Petroleum Technology, Nov. 1982, pp. 1246-1262.

Desbrondes, R. and J. Guoldron, "In Situ Rock Wettability Determination with Wireline Formation Tester Data", The Log Analyst, Jul.-Aug. 1988, pp. 244-251.

Desbrondes, R. "In Situ Wettability Determination Improves Formation Evaluation, Part 1, Wettability Concept", Pet. Eng. Inter., May 1989.

Desbrondes, R. "In Situ Wettability Determination Improves Formation Evaluation, Part 2", Petroleum Engineer International, Aug. 1989.

Desbrondes, R. "In Situ Wettability Determination in Gas Reservoirs", 1989 SPE Gas Technology Symposium Paper, Jun. 7-9, 1989.

*Primary Examiner*—Hezron E. Williams

*Assistant Examiner*—Michael J. Brock

*Attorney, Agent, or Firm*—William David Kiesel; Robert C. Tucker

[57] ABSTRACT

A method and apparatus for determining the wettability of an earth formation wherein a fluid sample from the wall of a borehole penetrating said formation is extracted then reinjected into the wall of the formation. A pressure versus time curve is generated throughout the test from which the wettability of the formation is determined by comparing how much the injection pressure varies from the static pressure to how much the extraction pressure varies from the static pressure. A wettability index can also be determined from the areas under the curve.

6 Claims, 4 Drawing Sheets

METHOD AND APPARATUS FOR DETERMINING THE WETTABILITY OF AN EARTH FORMATION

FIELD OF THE INVENTION

The present invention relates to a method and apparatus for determining the wettability of an earth formation. The apparatus is a wireline formation test tool wherein formation fluid is repeatedly drawn into the tool then re-injected into the formation. Pressure versus time is recorded throughout the test, which is plotted and the wettability of the formation obtained therefrom.

BACKGROUND OF THE INVENTION

Formation wettability has been the object of a substantial amount of research for the last forty years or so, primarily because of its impact on saturation and recovery estimates. Wettability describes how two immiscible fluids adhere to a solid. For reservoir rocks, wettability plays a major role in defining how hydrocarbon and water coexist in the pores and, therefore, influence numerous properties such as capillary pressure, relative permeability, water flood behavior and electrical properties and enhanced recovery.

Wettability strongly affects any parameter related to two-phase fluid displacement. An example is relative permeability, a major determinant in primary oil production and water floods. In uniformly wetted formations, the relative permeability to one fluid increases as the system becomes more wetted by the other fluid. In other words, permeability to the non-wetting fluid increases because the fluid is not "bound" to the pore surfaces and, therefore, becomes more mobile.

Another parameter affected by wettability is irreducible water saturation, which reaches a minimum in formations with near-neutral wettability. The irreducible water saturation level is the level above which the water of the formation will not flow. In fractionally-wet formations, irreducible water saturation also depends on the distribution and total area of water and oil-wet surfaces. Wettability also contributes to the dynamics of a water flood. In strongly water-wet formations, oil recovery is initially high but tapers off dramatically after breakthrough. In strongly oil-wet formations, breakthrough occurs early but production continues for a long time afterward.

Various methods, both quantitative and qualitative, are presently used to determine wettability. Major quantitative methods include the contact angle method, the Amott method, and the U.S. Bureau of Mines (USBM) method. All of these methods are described in, Wettability Literature Survey—Part 2: Wettability Measurement, William G. Anderson, Journal of Petroleum Technology, Nov. 1986, pages 1246–1262, which is incorporated herein by reference.

For pure materials, there are standard techniques for measuring the contact angle. But for rocks, or formations, the contact angle cannot take into account the heterogeneity of the rock surface. For example, a rough-surfaced rock causes the apparent contact angle to depart dramatically from the contact angle measured on a smooth surface. Contact angle measurements are difficult in porous media and so far impossible to obtain in situ. Other methods to characterize the wettability have been developed. They are based on capillary pressure measurements and involve laboratory analysis of a core sample—not in situ measurements. Laboratory measurements of wettability require considerable care in preserving and reproducing in situ conditions of the core samples. While the contact angle measurement 0 quantifies wettability for a specific surface, the two other methods (Amott and USBM), have been developed for gauging average wettability in oil field cores. Both use parts of the capillary pressure curve, a standard petrophysical laboratory measurement. Capillary pressure curves are obtained while draining (extracting the wetting phase), and imbibing (injecting the wetting phase). Imbibition begins spontaneously and is then forced.

The Amott method uses the spontaneous and forced-imbibition parts of the capillary curves. In this method, two ratios are compared in order to give wettability. One ratio is the volume of water imbibed spontaneously, divided by the total volume of water imbibed both spontaneously and forced. The core is initially centrifuged in oil to irreducible water saturation. The second ratio is similarly defined for oil imbibition, the core being initially centrifuged in water. Comparing these ratios tends to suppress effects of viscosity, permeability, and initial saturation. A limitation of the method is that it relies on spontaneous imbibition of the wetting fluid displacing the non-wetting fluid. This makes it adequate for measuring wettability for strongly water-wet and oil-wet formations, but not in neutrally wet formations.

The United States Bureau of Mines (USBM) method uses the drainage and forced-imbibition parts of the capillary pressure curves for determining a so-called Wettability Index. The work required by each fluid to displace the other is indicated by the areas under the curves—for oil driving water and for water driving oil. The Wettability Index is expressed as the logarithm of the ratio of the areas under the plotted capillary curves. If the index is greater than zero the formation is water-wet; if it is less than zero the formation is oil-wet; and if it is zero the formation is neutrally wet. Consequently, the USBM method has increased sensitivity in the neutral-wettability range because it does not depend on spontaneous imbibition. Nevertheless, neither the Amott nor the USBM methods are used to make measurements in situ within a borehole.

While much work has been done on developing new techniques and tools for determining the wettability of a formation, there is still much work that needs to be done. For example, until only a few years ago, oil-wet formations were considered a rare curiosity. But using advanced techniques of core handling and analysis, it was found that as many as half of the formations were either strongly oil-wet or of mixed or of fractional wettability.

Downhole test tools have been used for extracting fluid from a borehole well and measuring the fluid pressure during and after the flow into a chamber to get the flowing and static formation pressure. However, they do not perform a series of fluid drawings and re-injections.

Consequently, there still exists a substantial need as art for improved methods and formation test tools which can make in situ measurements in a borehole to determine wettability of a formation, particularly in zones of irreducible water saturation; that is, the zones above the oil water contact.

SUMMARY OF THE INVENTION

In accordance with the present invention there is provided a method for performing multiple extraction and injection pressure measurements in an earth formation penetrated by a well borehole, where: (i) the mud is a water base mud and the formation is a hydrocarbon zone or (ii) the mud is a hydrocarbon base mud and the formation is water saturated, which method comprises:

(a) establishing, through the wall of the well borehole and isolated from fluids within the borehole, a direct fluid flow path for communication with an adjacent formation to be measured;

(b) drawing a fluid sample from the wall of the borehole;

(c) injecting the fluid sample back into the wall of the borehole; and (d) continuously measuring and recording pressure versus time during steps (b) and (c).

In a preferred embodiment of the present invention, the wettability of the formation is determined from the pressure versus time curve by comparing how much the injection pressure varies from the static pressure relative to how much the extraction pressure varies from the static pressure.

There is also provided a wireline test tool comprised of:

(a) an elongated body for passage through a borehole;

(b) anchoring and sealing means on said tool for anchoring the tool to the borehole and sealingly engaging a segment of the wall of the borehole, wherein said means is comprised of a pair of extendible pads on opposing sides of the tool;

(c) a sampling chamber means in said test tool fluidly connected to a port in one of the pads of said sealing means;

(d) a means for drawing fluid into the chamber and expelling fluid out of the chamber and into the wall of the borehole; and (e) a means for sensing and recording the pressure of a fluid in said sampling chamber.

DETAILED DESCRIPTION OF THE INVENTION

Figure 1:
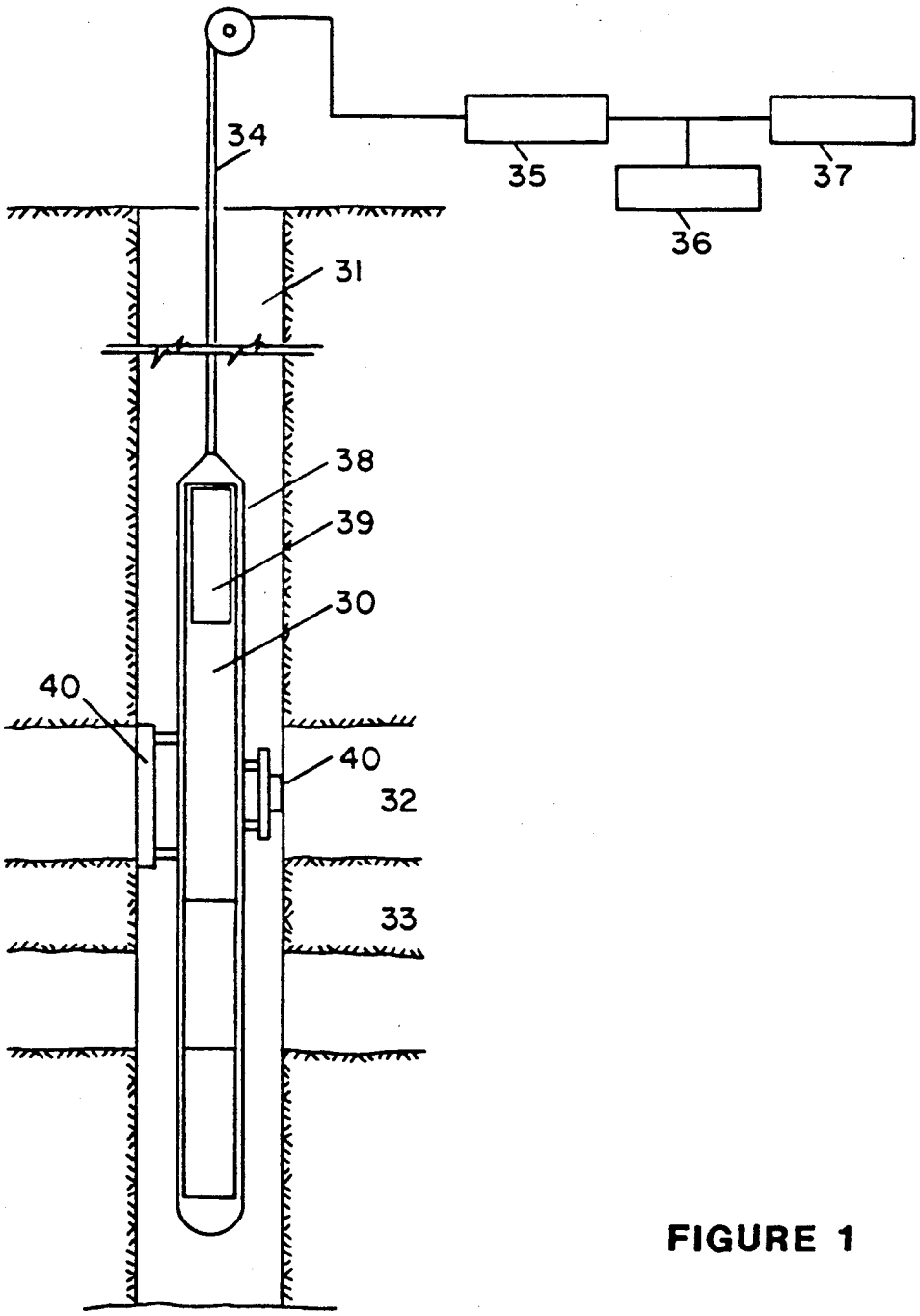
FIG. 1 hereof depicts a wireline formation test tool of the present invention shown in position down a borehole.

Turning now to FIG. 1, a preferred embodiment of a new and improved measuring tool 30 incorporating the principles of the present invention is shown as it will appear during the course of a typical measuring operation in a borehole 31 penetrating one or more earth formations as at 32 and 33. As illustrated, the tool 30 is suspended in the borehole 31 from the lower end of a typical multi-conductor cable 34 that is spooled in the usual fashion on a suitable winch (not shown) at the surface and coupled to the surface portion of a tool control system 35 as well as typical recording and indicating apparatus 36 and a power supply 37. In its preferred embodiment, the tool 30 includes an elongated body 38 which encloses the downhole portion of the tool control system 39 and carries selectively extendible tool anchoring and sealing means 40 on opposing sides of the body.

Figure 2:
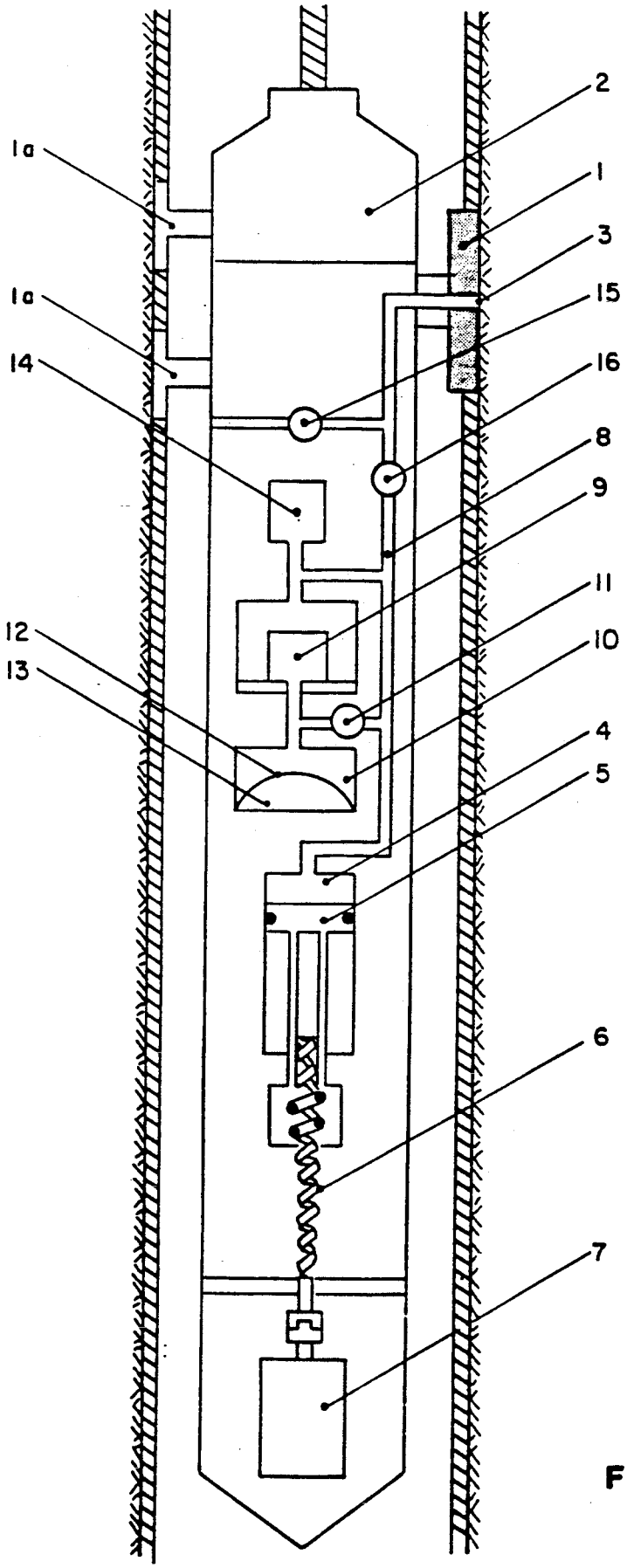
FIG. 2 hereof is a schematic representation of a formation test tool incorporating the principles of the present invention.

FIG. 2 is a schematic representation of the formation-test tool illustrated in FIG. 1 as the tool will appear in its operating position. FIG. 2 shows a pad, or shoe, 1 pushed against the borehole. Pad 1*a*, which is on the opposite side of the tool as pad 1, is used primarily to hold the tool in place in the borehole. Any conventional means can be used to activate the pads, which means will be housed in section 2 of the tool. A port 3 at the center of the pad is open and connected to a chamber 4 of variable size by means of a connecting line 8. The size of the chamber will generally be from about 0.25 to 100 cc depending on the depth of the invasion. That is, the distance that liquid phase mud has penetrated the formation. The size of the chamber is such that not all of the liquid phase mud will fill the chamber so that even when the chamber is full there is still invasion of liquid phase mud into the formation. One mode of construction of the chamber consists of a piston 5 moved by a screw 6 which is rotated by an electric motor 7. It is to be understood that the volume of the chamber can be varied by any other appropriate means including a hydraulic means. The volume of the chamber is varied, and can be either increased to draw in fluid or reduced to expel, that is, inject fluid into the wall of the borehole. The volume is varied so that the flow rate of fluid in and out of the tool will be in the range of about 0.05 to 30 cc/min, depending on the permeability of the formation. That is, for low permeability formations the flow rate will be on the low end, and for high permeability formations the flow rate will be on the high end.

The fluid pressure in the connecting line 8 is measured with a very precise pressure gauge 9 which can be of the quartz type or of the strain gauge type. It can be an absolute pressure gauge or a differential pressure gauge. In the latter case, a pressure sink 10 must be provided and isolated when the system is at formation pressure by closing the valve 11. The pressure sink comprises a membrane 12 sealing a chamber of gas 13. A less sensitive pressure gauge 14 must also be provided for monitoring the absolute pressure. A valve 15 allows the connecting line to access the borehole mud for pressure equalizing at the end of a test. A flow line valve 16 is used for isolating the pressure measuring and sampling section of the tool during tripping.

Generally, a measurement is made in accordance with the principles of the present invention by:

(a) positioning a wireline test tool down a borehole adjacent to the formation to be tested;

(b) engaging a pad sealing means against the wall of the formation thereby isolating a surface of the wall of the borehole from fluid in the borehole, wherein one of the pads has a port to allow entry of fluid into the tool;

(c) drawing fluid into the test tool and reading the formation pressure;

(d) repeatedly injecting and extracting fluid while measuring and recording the pressure as a function of time.

More specifically, for the specific test tool of FIG. 2 hereof, a measurement would be taken as follows:

1. Applying the pad to the borehole wall by any appropriate means at a selected depth in the borehole.
2. Opening flow line valve 16.
3. Increasing the volume of the chamber 4 by rotating the electric motor 7 and drawing fluid into the chamber.
4. Reading the formation pressure.
5. Closing valve 11 of the pressure sink if a differential pressure gauge is used.
6. Re-injecting fluid into the wall of the formation.
7. Reading the pressure equilibrium and record data.
8. Repeating, preferably with various fluid volumes and flow rates, the drawing and injection.
9. Opening the sink valve 11 if a differential pressure gauge is used.
10. Closing flow line valve 16.
11. Opening equalizing valve 15.
12. Releasing pads 1 and 1*a* from the borehole wall.
13. Move to another depth and repeat, if desired.

Figure 3:
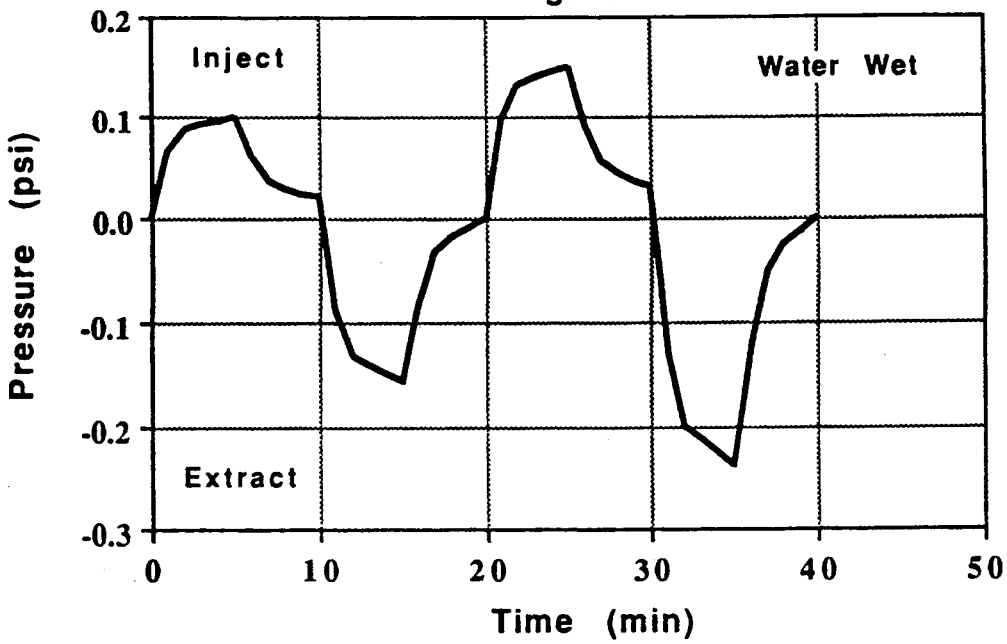
FIG. 3 hereof is a pressure versus time plot which will be obtained by the practice of the present invention for a water base mud in a water-wet formation.
Figure 4:
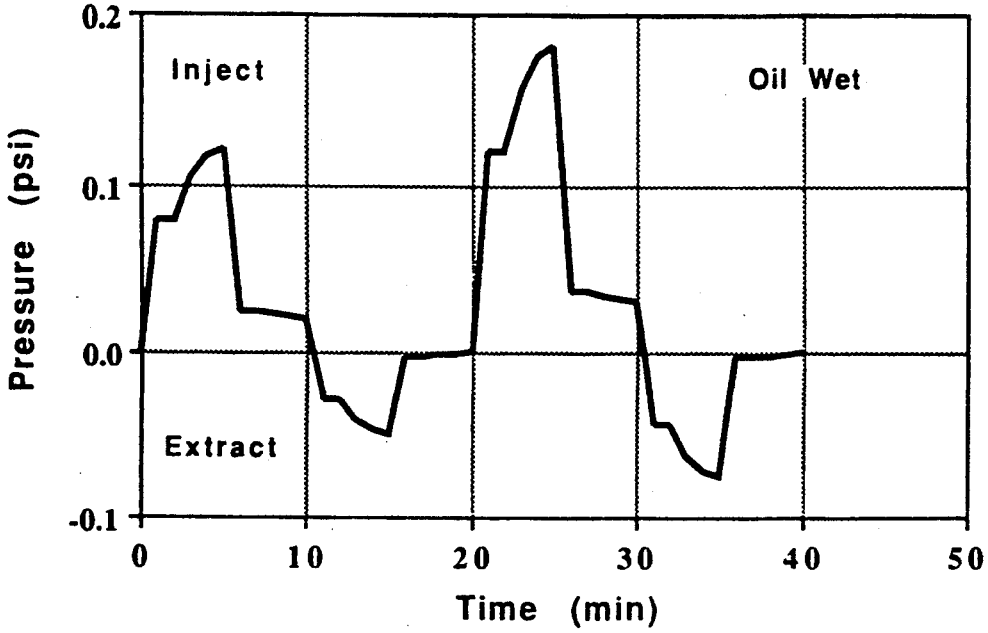
FIG. 4 hereof is a pressure versus time plot which will be obtained by the practice of the present invention for a water base mud in an oil-wet formation.
Figure 5:
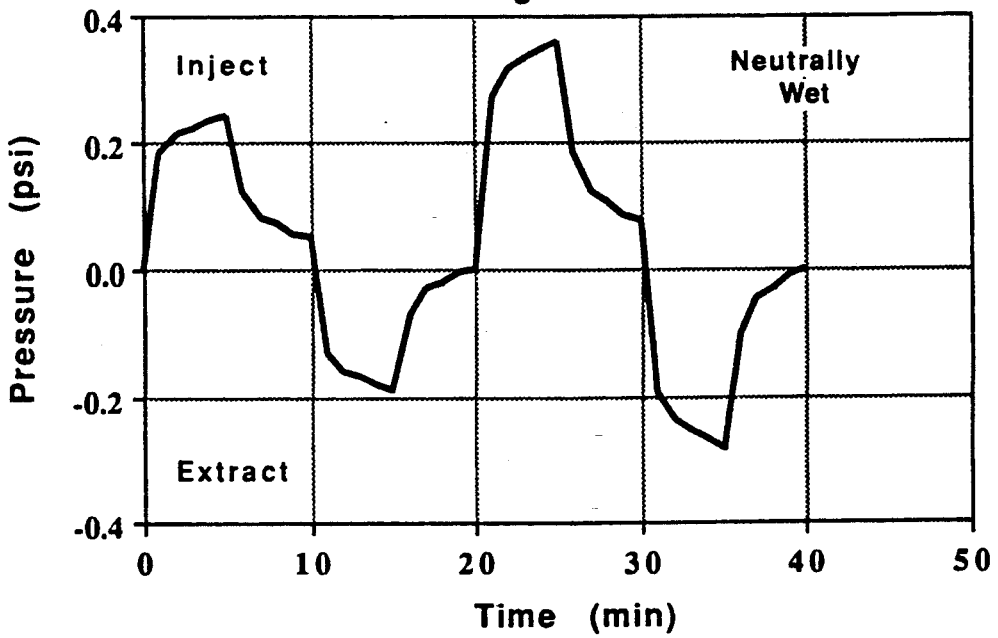
FIG. 5 hereof is a pressure versus time plot which will be obtained by practice of the present invention for a water base mud in a neutrally wet formation.

The types of pressure versus time curves which will be obtained from the practice of the present invention, when the mud is a water base mud, are shown in FIGS. 3, 4 and 5 hereof. FIG. 3 hereof represents a water-wet formation. As can be seen in the figure, injection pressure varies less from static pressure than does the extraction pressure. FIG. 4 is a pressure versus time curve for an oil-wet formation and, conversely, the injection pressure varies more from the static pressure than does the extraction pressure. In a neutrally wet formation, as represented by FIG. 5 hereof, the pressure variations, from static pressure, are substantially equal. Thus, by practice of the present invention, the resulting pressure versus time curves can be qualitatively analyzed to determine the wettability of the formation. A quantitative determination of the wettability can also be made, which will be similar to the USBM Wettability Index. This is done by calculating the area under the injection and extraction curves and using the formula:

$$W = \log A_e/A_1$$

where

W is a wettability index of the formation;

$A_e$ is the area under the extraction curve; and $A_i$ is the area under the injection curve.

When W is greater than 0 the formation is water-wet. When W is less than 0 the formation is oil-wet, and when W is 0 the formation is neutrally wet. Practice of the present invention assumes however, that the mud filtrate, which moves back and forth in the invaded transition zone, is free of surfactants and consequently does not change the wettability of the formation.

It will be noted that practice of present invention with regard to determining wettability of a formation from the pressure versus time curves will only be relevant when the mud is a water base mud and the formation is a hydrocarbon zone or when the mud is oil base and the formation is water saturated.

It will also be noted that when the injection is stopped, the pressure fall-off is different for a water-wet formation then for an oil-wet formation. The pressure fall-off versus time is longer in a water-wet formation when injecting water. Conversely, the pressure fall-off is shorter in an oil-wet formation when injecting water. This phenomenon can be related qualitatively to the wettability of the formation. It can be most clearly demonstrated by reducing and increasing chamber volume by using short injection or extraction pulses of the length of about 1 to 10 seconds, followed by a short interval of no flow of about 1 to 10 second. In a water-wet formation, a quasi-flat pressure response is measured and a widely varying pressure is measured in an oil-wet formation.

The following examples will serve to more fully describe the invention. It is understood that these examples are not intended to limit the true scope of this invention, but rather are presented for illustrative purposes.

EXAMPLE 1

A sand bed was designed to simulate typical earth formations. The bed of sand was cylindrical and was 4 inches in diameter and 2 feet high. The sand was Ottawa #F-95 sand, wherein about 48% of the grains had an average particle size of about 0.105 mm. The bed of sand was prepared by first saturating it with water, then replacing most of the water with oil having an API of 33°. This resulted in a bed of sand comprised of about 80 vol.% oil and 20 vol.% water, which is typical of a water-wet earth formation containing connate fluids. An aqueous brine solution containing 35,000 ppm of sodium chloride was pulsed into (injected) into the bed of sand with repeated cycles of two 4 second intervals. One interval was a 4 second injection and the other was an interval was no flow took place. That is, a hold period. This cycle was continued for 5 minutes followed by a 5 minute hold. An extraction cycle of two 4 second intervals was then initiated wherein fluid was extracted from the sand bed for 4 seconds followed by a 4 second hold. This cycle was continued for 5 minutes which was followed by a 5 minute hold. FIG. 3 hereof is the pressure versus time curve resulting from the above procedure. This figure evidences that for a water-wet formation, the injection pressure varies less from static pressure than does the extraction pressure.

EXAMPLE 2

The above experiment except that the sand bed was pretreated with an organosilane compound to simulate a typical oil-wet earth formation. FIG. 4 resulted from this experiment and evidences that the injection pressure varies more from static pressure than does the extraction pressure for an oil-wet formation.

EXAMPLE 3

The procedure of Example 1 above was followed except the bed of sand was comprised of a 1 to 1 mixture of sand from Example 1 and Example 2. This was done to simulate a typical neutrally wet earth formation. FIG. 5 resulted from this experiment which evidences that for a neutrally wet formation, the injection pressure and the extraction pressure vary substantially the same from static pressure.

While only one particular embodiment of the present invention and two modes of practicing the invention have been shown and described, it is apparent that changes and modifications may be made without departing from this invention in its broader aspects.

What is claimed is:

1. A method for performing multiple extraction and injection pressure measurements in an earth formation penetrated by a well borehole, which borehold contains drilling mud, where: (i) the mud is a water base mud and the formation is a hydrocarbon zone or (ii) the mud is a hydrocarbon base mud and the formation is water saturated, which method comprises:

(a) establishing, through the wall of the well borehole and isolated from fluids within the borehole, a direct fluid flow path for communication with an adjacent formation to be measured;

(b) drawing a mud filtrate sample from the wall of the borehole;

(c) injecting the mud filtrate sample back into the wall of the borehold; and (d) continuously measuring and recording the pressure versus time during steps (b) and (c).

2. The method of claim 1 wherein steps (b), (c) and (d) are repeated at least once.

3. The method of claim 1 wherein step (b) and (c) are each conducted in pulses such that a short injection or extraction pulse is followed by an equivalent period of no-flow, which is followed by another pulse of injection or extraction, followed by another equivalent period of no-flow, and so on for an effective amount of time.

4. A method for obtaining multiple pressure measurements in the same location of an earth formation traversed by a well borehole, by use of a wireline test tool having a pressure sampling chamber, a pressure measuring means, in open communication with a pad sealing means, wherein the borehole contains drilling mud, and where (i) the mud is a water base mud and the formation is a hydrocarbon zone, or (ii) the mud is a hydrocarbon base mud and the formation is water saturated, which method comprises:

(a) positioning said wireline test tool down a borehole adjacent to the formation to be tested;

(b) moving a pad sealing means on the test tool into engagement with the wall of a borehole and isolating a wall segment of the earth formation;

(c) drawing a mud filtrate into the chamber of the tool from the formation wall through a port in the pad sealing means;

(d) injecting mud filtrate from the tool back into the wall of the formation; and (e) recording the pressure versus time throughout the test.

5. The method of claim 4 wherein steps (b) and (c) are repeated one or more times.

6. The method of claim 4 wherein steps (b) and (c) are repeated one or more times for various fluid volumes and flow rates.

* * * * *